US008459460B1

(12) United States Patent
Hansen et al.

(10) Patent No.: US 8,459,460 B1
(45) Date of Patent: Jun. 11, 2013

(54) ACCESSIBLE DISPLAY PACKAGE AND METHOD OF USE

(75) Inventors: Victor D. Hansen, Rockford, MI (US); George E. Raimer, Saranac, MI (US); Martin O. Tidball, Rockford, MI (US); Michael J. Cramblet, Muskegon, MI (US); Lynn L. Hitchcock, Kentwood, MI (US); Elliott R. Eckert, Grand Rapids, MI (US)

(73) Assignee: Display Pack, Inc., Grand Rapids, MI (US)

( * ) Notice: Subject to any disclaimer, the term of this patent is extended or adjusted under 35 U.S.C. 154(b) by 0 days.

(21) Appl. No.: 13/489,702

(22) Filed: Jun. 6, 2012

(51) Int. Cl.
*B65D 73/00* (2006.01)

(52) U.S. Cl.
USPC ..... 206/769; 206/462; 206/470

(58) Field of Classification Search
USPC ..... 206/736, 738, 751, 756, 759, 769, 206/461, 462, 463, 467, 470, 471
See application file for complete search history.

(56) References Cited

U.S. PATENT DOCUMENTS

| | | | | |
|---|---|---|---|---|
| 3,111,220 | A | 11/1963 | Donald | |
| 4,083,451 | A | 4/1978 | Hair | |
| 4,266,666 | A | 5/1981 | Kuchenbecker | |
| 4,319,684 | A | 3/1982 | Backman et al. | |
| D263,684 | S | 4/1982 | Davis | |
| 4,456,124 | A | 6/1984 | Kay et al. | |
| 4,666,037 | A | 5/1987 | Weissman | |
| 4,739,883 | A | 4/1988 | Mohs et al. | |
| D305,000 | S | 12/1989 | Hernandez | |
| 4,884,718 | A * | 12/1989 | Leahy | 220/835 |
| 5,092,479 | A | 3/1992 | Wells | |
| D376,314 | S | 12/1996 | Krupa | |
| 5,595,300 | A * | 1/1997 | Paik et al. | 206/449 |
| 5,775,516 | A | 7/1998 | McCumber et al. | |
| D407,015 | S | 3/1999 | Jones | |
| D411,448 | S | 6/1999 | Baker | |
| D420,905 | S | 2/2000 | Adkins | |
| 6,053,321 | A | 4/2000 | Kayser | |
| 6,230,964 | B1 | 5/2001 | Saito | |
| 6,237,772 | B1 * | 5/2001 | LaMarche et al. | 206/470 |
| 6,244,444 | B1 | 6/2001 | Jacobus et al. | |
| D448,288 | S | 9/2001 | Zettle et al. | |
| 6,308,832 | B1 | 10/2001 | Pirro et al. | |
| 6,311,845 | B1 * | 11/2001 | Uren et al. | 206/774 |
| 6,364,115 | B1 | 4/2002 | Casanova et al. | |
| D479,127 | S | 9/2003 | Jowett | |
| D531,028 | S | 10/2006 | Weiss et al. | |
| D534,421 | S | 1/2007 | Tanner | |

(Continued)

OTHER PUBLICATIONS

Design Drawings dated Feb. 2, 2009.

*Primary Examiner* — Jacob K Ackun
(74) *Attorney, Agent, or Firm* — Warner Norcross & Judd LLP

(57) ABSTRACT

The present invention provides a box package having a clamshell with a panel assembly, and a method of manufacturing and using a box package. The clamshell includes a first part and a second part adapted to form a cavity. The first and second parts are movable relative to one another about an operating hinge between an open position and a closed position. A panel assembly covers at least a portion of each of the first and second parts. The clamshell may include more than one manufacturing hinge, and at least one of the manufacturing hinges may divide the first and second parts. The panel assembly may define an access window and at least a portion of the first part may open and close through the access window.

16 Claims, 8 Drawing Sheets

U.S. PATENT DOCUMENTS

| | | | | |
|---|---|---|---|---|
| 7,258,233 | B2 * | 8/2007 | Lee | 206/470 |
| D553,489 | S | 10/2007 | Lambert et al. | |
| D600,113 | S | 9/2009 | Edwards et al. | |
| D601,014 | S | 9/2009 | Petitjean | |
| D606,392 | S | 12/2009 | Prevost | |
| D615,858 | S | 5/2010 | Prevost | |
| D624,399 | S | 9/2010 | Hansen et al. | |
| D624,402 | S | 9/2010 | Hansen et al. | |
| D624,403 | S | 9/2010 | Hansen et al. | |
| D624,815 | S | 10/2010 | Hansen et al. | |
| 7,931,148 | B2 | 4/2011 | Hansen et al. | |
| 2002/0195363 | A1 | 12/2002 | Tuneberg | |
| 2006/0016711 | A1 * | 1/2006 | Ritter | 206/470 |
| 2006/0042986 | A1 * | 3/2006 | Simkowski | 206/470 |
| 2008/0118609 | A1 | 5/2008 | Harlfinger | |

* cited by examiner

ACCESSIBLE DISPLAY PACKAGE AND METHOD OF USE

BACKGROUND OF THE INVENTION

The present invention relates to packaging, and more particularly to point-of-sale product packages.

A wide variety of products intended for retail sale are packaged in packaging that includes plastic components. One of the most common forms of plastic point-of-sale packages is a blister package. A typical blister package includes a shaped plastic blister that forms the main cavity of the package and a backer panel that closes the cavity. The backer panel is often sealed to the blister, for example, by adhesive to enclose the product within the cavity. The backer panel may be formed from paperboard, plastic, aluminum or other similar materials. The amount of plastic used in blister packages is relatively small and the backer panel can be sized to provide ample space for printed content. The package is also secure, as the backer panel is often secured to the blister. However, in a blister configuration, the package must generally be destroyed by ripping the backing from the blister to access the contents of the package.

Another common form of plastic point-of-sale package is a package with an outer box typically made of paperboard that houses an inner plastic sheath. The box may have a hole cut in it to allow consumers to view the contents of the box through the plastic sheath. In these configurations, the box generally has a top panel with a tongue that may be opened and closed to gain access to the contents of the box. Although relatively secure, the box configuration can be difficult to open, and can involve destroying or damaging the packaging to access the contents of the package.

SUMMARY OF THE INVENTION

The present invention provides a box package having a clamshell fitted within a box. The box package and clamshell are configured so that the clamshell may be opened and closed through the box to provide selective access the contents of the package without opening or damaging the box. In one embodiment, the clamshell is a one-piece component that includes a first part and a second part that cooperatively form a reclosable article-receiving cavity. The clamshell may include a manufacturing hinge that allows the clamshell to be folded into the closed position, and an operating hinge that allows the first and second parts to move relative to one another between an open position and a closed position.

In one embodiment, the first part may include a plurality of sections that are folded to form a door. In this embodiment, the first part may include a center section, a left section and a right section. The left and right sections are configured to fold with respect to the center section to form the side faces of the door. In an alternative embodiment, the first part of the clamshell may be formed into the three-dimensional shape of a door. For examiner, the first part may be thermoformed into the shape of a door, In one embodiment, the clamshell may include more than one manufacturing hinge that allows the one-piece clamshell to be folded into the closed position in at least two different locations. At least one of the manufacturing hinges may divide the first and second parts.

In one embodiment, the box is formed from a panel assembly that is capable of being folded into the shape of a box. For example, the box may be manufacturing from a paperboard blank that is cut into an arrangement of panels configured to fold into a box. The panel assembly may be glued or otherwise secured in the folded condition.

In one embodiment, the panel assembly defines an access window, with at least a portion of the first part adapted to open through the access window. The operating hinge may be disposed adjacent an edge of the access window to allow the first part to pivot between the open and closed positions.

In another embodiment, at least one of the first and second parts may have at least one fastener element releasably securing the first and second parts in the closed position. The fastener element may be any of a variety of fastener elements, including a friction fit created by two corresponding recesses in the clamshell, and a protrusion extending from the clamshell through an aperture in the panel assembly.

In another embodiment, the first part may include at least one of a radius and an angle configured to provide clearance when the first and second parts are moved between open and closed positions.

In another embodiment, the panel assembly has at least one panel at least partially extending along a depth of the panel assembly. In one embodiment, the panel assembly includes four panels that give the box depth and interconnect the front and rear panels.

In another aspect of the invention, a method is provided for forming a package including forming a clamshell including first and second parts, an operating hinge, and a manufacturing hinge. The clamshell is folded to position the first part adjacent the second part to form an article-receiving cavity. The clamshell is fitted into a box having an access opening that provides access to the first part. The first part may be pivoted away from the second part about the operating hinge to move at least a portion of the first part through the access window and open the package.

These and other advantages and features of the invention will be more fully understood and appreciated by reference to the detailed description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and may be practiced or carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

I. Overview

Figure 1:
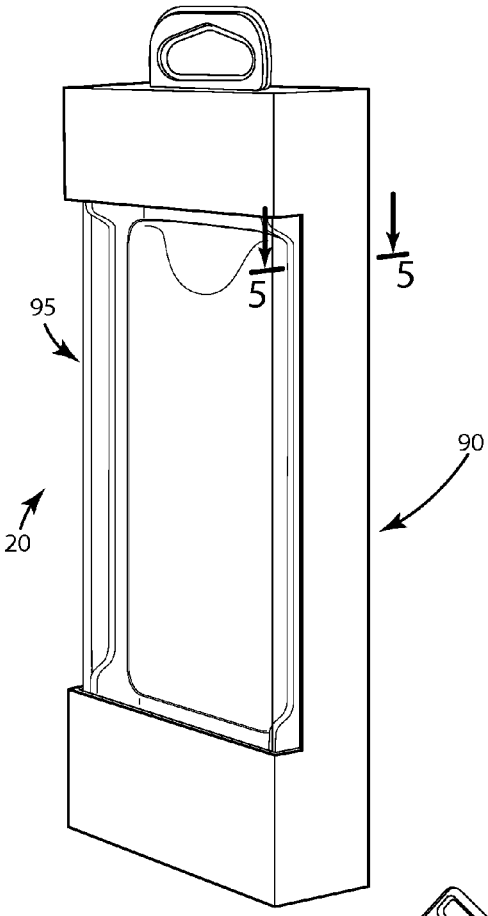
FIG. 1 is a perspective view of a package in accordance with an embodiment of the present invention.

A box package in accordance with an embodiment of the invention is shown in FIGS. 1-5 and is generally designated 10. The box package 10 is designed to hold and display articles at the point of sale or point of purchase. The box package 10 may be opened and closed to allow customers to selectively access the contents of the package 10. The box package 10 generally includes a clamshell 20 that is fitted within a box. In this illustrated embodiments, the box is formed from a panel assembly 90. The clamshell 20 of the illustrated embodiment is a one-piece component having first and second parts 22, 54 separated by a manufacturing hinge 42 and an operating hinge 50. The manufacturing hinge allows the clamshell 20 to folded into the desired shape during manufacture of the package 10. The operating hinge 50 allows the first part 22 to be opened and closed with respect to the second part 54 to provide selective access to the packaged article(s).

Although described in the context of a point-of-sale/point-of-purchase package, the present invention may be incorporated into other types of reclosable packages. The present invention is described in the context of a box package having a thermoformed plastic clamshell and a paperboard panel assembly. The box package may, however, be manufactured from different materials using different manufacturing techniques.

Directional terms, such as "vertical," "horizontal," "left," "right," "center," "front," "back," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

II. Construction

As noted above, the box package 10 generally includes a clamshell 20 and a box (panel assembly 90). More specifically, in this embodiment, the clamshell 20 is fitted into the interior of the box formed by panel assembly 90. The clamshell 20 of the illustrated embodiment is a one-piece component having a first part 22 and a second part 54. The second part 54 is generally configured to form a receptacle for the article(s) to be packaged. The first part 22 is generally configured to form a door that can be opened and closed to provide selective access to the contents of the package 10.

The first part 22 of the clamshell 20 may include a right side section 24, a center section 26 and a left side section 28. Each of the clamshell "sections" may also be referred to as "faces." A flexible joint 30, 32 may be positioned between the right side section 24 and the center section 26, and between the center section 26 and the left side section 28. The flexible joints 30, 32 may provide a flexible joint about which to move the right side section 24, center section 26 and left side section 28. The flexible joints 30, 32 may be any suitable joint providing a desired level of flexibility. For example, the flexible joints 30, 32 can be a line of weakening, a fold line, a line of reduced thickness, a perforation or micro-perforation, a standard hinge or a square hinge. A micro-perforated configuration may limit the visibility of the perforations to consumers. In the illustrated embodiment, the sections 24, 26, 28 are substantially planar and are folded so that the right and left side sections 24, 28 are substantially parallel to each other, and both of the right and left side sections 24, 28 are substantially perpendicular to the center section 26. Any other suitable number of sections and angular relationship between the sections is also considered. For example, the first part 22 may include a single rounded section, or may include many angled sections with suitable joints between each section.

Figure 3:
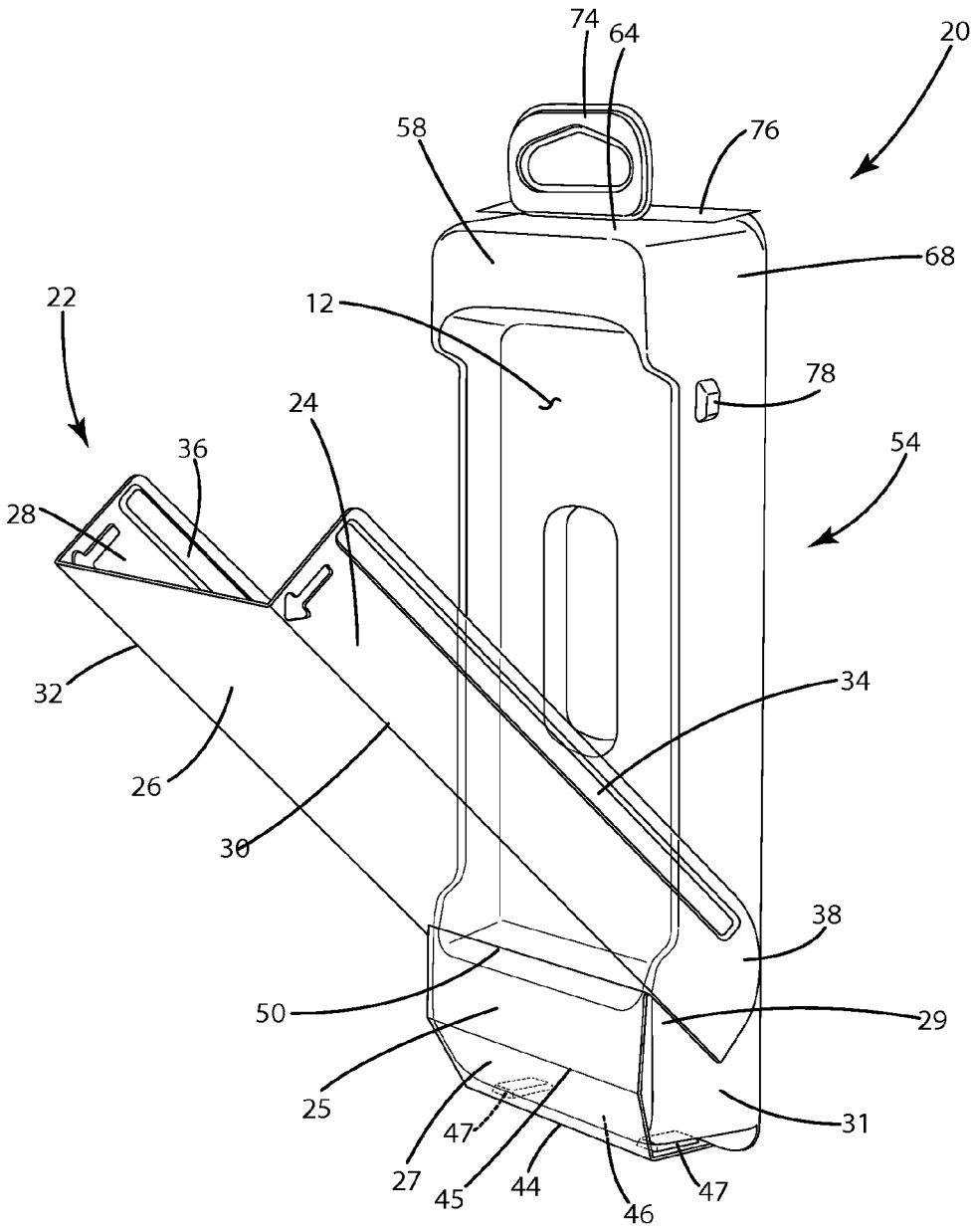
FIG. 3 is a perspective view of the clamshell of FIG. 1.
Figure 4:
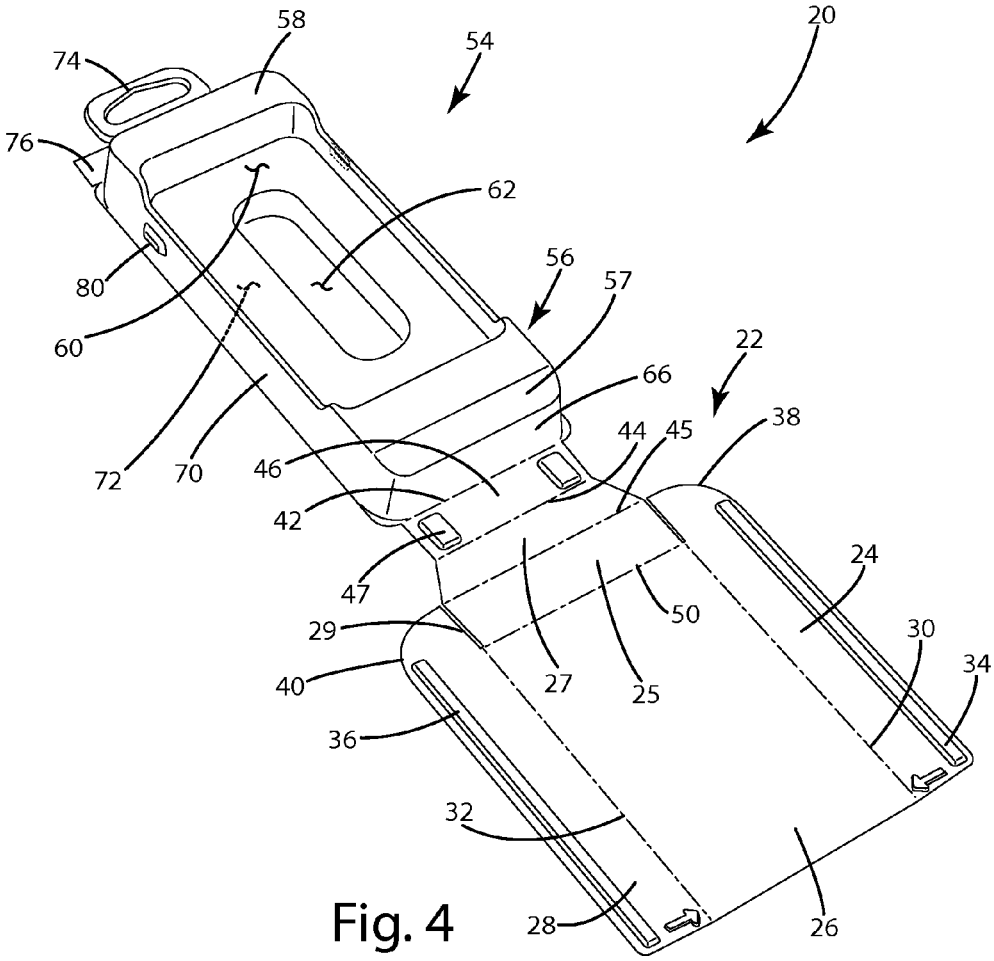
FIG. 4 is a perspective view of the clamshell of FIG. 1.

As shown in FIGS. 3-4, a lower part of the right and left side sections 24, 28 and the center section 26 may define a separation 29 to allow the first part 22 to pivot to the open position. The right and left side sections 24, 28 may each include a radius 38, 40 to provide clearance for the right and left side sections 24, 28 when moving the first and second parts 22, 54 relative to one another during opening and closing of the package 10. Optionally, the radius 38, 40 may be any suitable void to provide the desired clearance. For example, an angular configuration may be used in which the radius 38, 40 is replaced with a straight edge between the points at which the illustrated radius 38, 40 begins and ends. Further optionally, multiple angular edges may connect to one another to provide the desired clearance. A void 31 may be formed by the first and second parts 22, 54 and the panel assembly 90 to receive the separated portion of the right and left side sections 24, 28. The separated portion of the right and left side sections 24, 28 may move within the void 31 during opening and closing of the package 10, and may be configured to contact the remainder of the clamshell 20 and/or the panel assembly 90 to provide stability during opening and closing. Optionally, the radius 38, 40 may contact a back section 104 of the panel assembly 90 during opening and closing of the package 10.

The first part 22 may include one or more manufacturing hinges 44, 45 about which portions of the first part 22 may be moved and pivoted during manufacture of the package 10. The manufacturing hinges 44, 45 may be any suitable joint providing a desired level of flexibility, including those mentioned above. As shown in the illustrated embodiment, the manufacturing hinges 44, 45 may be substantially parallel to one another. Manufacturing hinges 44, 45 may separate a bottom section 46, a lower center section 27 and an upper center section 25 of the first part 22. The manufacturing hinges 44, 45 may allow the bottom section 46, the lower center section 27, and the upper center section 25 to be moved to any desired angle with respect to one another. In the assembled clamshell embodiment shown in FIG. 3, the bottom section 46 is substantially perpendicular to the upper center section 25, and the lower center section 27 is positioned at approximately a 45° angle with respect to the bottom section 46 and the upper center section 25. Optionally, any of the angular relationships may be altered as desired. As shown in FIG. 4, bottom section 46 may have one or more protrusions 47 to provide added strength and to maintain a desired spacing between bottom section 46 of first part 22 and bottom section 66 of second part 54. Bottom section 46 may substantially extend in a direction of a depth of the clamshell 20.

The first part 22 may include an operating hinge 50 separating the upper center section 25 from a remainder of the center section 26. The operating hinge 50 may allow the center second 26 and the upper center section 25 to move relative to each other to open and close the package 10. In this manner, the operating hinge 50 may also allow the first part 22 and the second part 54 to move relative to each other during opening and closing of the package 10. The operating hinge 50 may be any suitable joint providing a desired level of flexibility, including those mentioned above. Optionally, a pull tab 52 may extend from the first part 22 to assist in opening the package 10. Further optionally, the pull tab 52 may extend from a top of center section 26.

The first and second parts 22, 54 may be divided by a manufacturing hinge 42. The manufacturing hinge 42 can be any suitable type of connection that allows the first and second parts 22, 54 to move with respect to each other. The manufacturing hinge 42 may allow the first and second parts 22, 54 to be moved with respect to one another to any suitable angle. As shown in the illustrated embodiment, the manufacturing hinges 42, 44, 45 and the operating hinge 50 may each be spaced from one another and substantially parallel to one another.

The second part 54 may include a lower front section 56 and an upper front section 58 configured to interface with the panel assembly 90 in the assembled package 10. The lower front section 56 may include an angled section 57 adapted to interface with the lower center section 27 of the first part 22 when the package 10 is assembled. For example, the angled section 57 may be positioned at approximately a 45° angle with respect to the remainder of the lower front section 56 to match the angle of the lower center section 27 of the first part 22. It has been found that forming angled section 57 at an angle better facilitates flow of the plastic through the mold during formation of the second part 54. Optionally, angled section 57 may be arranged at any suitable angle, may include multiple angled sections, or may be curved.

The second part 54 may include a recessed section 60 and an inner recessed section 62 adapted to form desired portions of the package 10. For example, recessed section 60 may be adapted to receive a portion of the packaged product, and inner recessed section 62 may be adapted to receive a portion of the packaged product. The number, relative sizes and shapes of the recesses 60, 62 may be changed based on the application. Second part 54 includes a top section 64, a bottom section 66, a right section 68, and a left section 70. Together with the recessed section 60 and the inner recessed section 62, these sections form a rear cavity 72 which may contain any desired item, including accessories and product information. The size and shape of recessed section 60, inner recessed section 62, top section 64, bottom section 66, right section 68 and left section 70 may be changed to change the size and shape of the package 10, depending on the application. The second part 54 may include a hangtag 74 for hanging the box package 10 on a display rack, and a flap 76 connecting the hangtag 74 to the top section 64.

A fastener element may be defined in one or both of the first part 22 and second part 54 to releasably secure the first and second parts 22, 54 in the closed position. As shown in FIGS. 2-5, a recess 34, 36 may be included in one or both of the right and left sections 24, 28 of the first part 22, and a protrusion 78, 80 may be included in one or both of the right and left sections 68, 70 of the second part 54. The recesses 34, 36 and protrusions 78, 80 may extend any suitable distance, including substantially the entire length of the right and left sections 24, 28 of first part 22 and substantially the entire length of the right and left sections 68, 70 of second part 54, respectively. As illustrated, the protrusions 78, 80 may optionally be shorter than the recesses 34, 36. The recesses 34, 36 and protrusions 78, 80 may be adapted to engage one another when the first part 22 is moved to the closed position to releasably retain the first part 22 in the closed position. The recesses 34, 36 and protrusions 78, 80 may form any suitable releasable engagement, including an interference fit, as shown in the illustrated embodiment. In the embodiment shown in FIG. 5, the recess 34 on first part 22 is moved past the protrusion 78 on second part 54 to open or close the package 10. The interaction of the ramped surfaces of the recess 34 and the protrusion 78 resists this movement, which provides a releasable fastener element for the package 10. Optionally, any suitable fastener element may be used to maintain releasable engagement between the first part 22 and the second part 54.

The first and second parts 22, 54 can be integrally formed, separately formed and attached to one another, or separately formed and attached to another element of the box package 10. For example, if separately formed, one or both of the first and second parts 22, 54 may be attached to or loosely confined by the panel assembly 90. The clamshell 20 can be formed by any suitable process including injection molding and thermoforming. The clamshell may optionally be formed by a one-sided die. A one-piece clamshell design eliminates the extra manufacturing step of aligning a separate second part 54 over the first part 22 when closing the clamshell 20. Rather, the placement of the manufacturing hinge 42 allows the first and second clamshell parts 22, 54 to be guided to an aligned, folded position when folded about the manufacturing hinge 42. When the clamshell 20 is pivoted or folded about the hinge 42 to a closed position, the first and second parts 22, 54 form the enclosed cavity 12. The clamshell 20 can be virtually any desired size and shape depending on the article to be packaged and on aesthetic considerations. The clamshell is typically constructed from polyvinyl chloride (PVC) or polyethylene terephthalate (PET) or some other polymer. Although the clamshell stock is typically transparent, translucent or clear, the stock may also be opaque, clouded or tinted any suitable color in some applications. The clamshell 20 will vary in thickness from application to application. For standard applications, the clamshell 20 is likely to have a thickness ranging between 12 and 30 gauge (i.e., 12 to 30 thousands of an inch).

Figure 2:
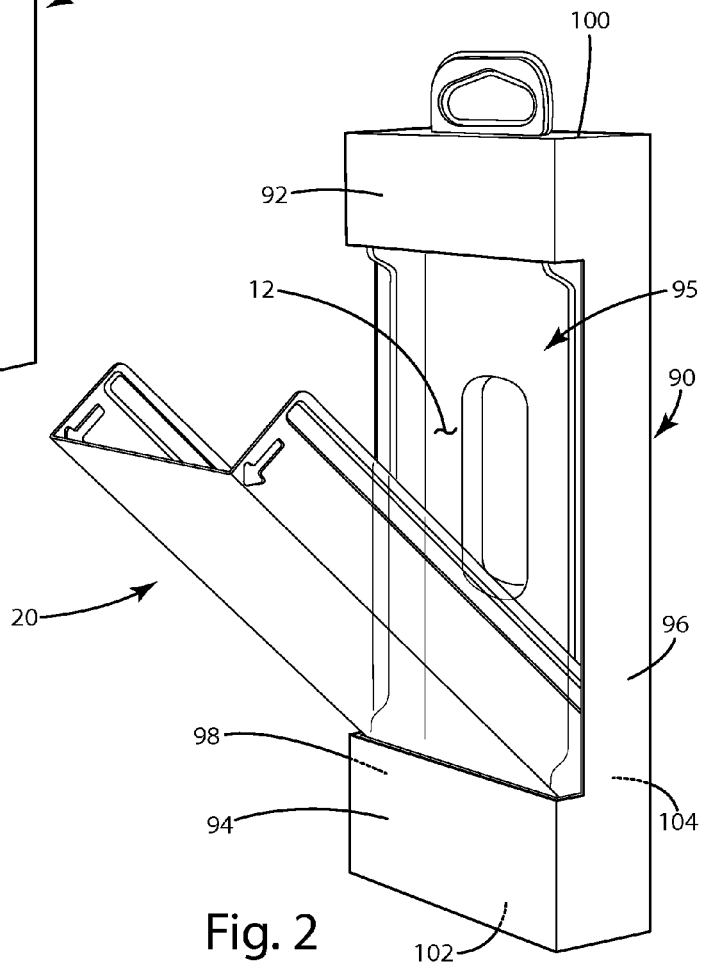
FIG. 2 is a perspective view of the package of FIG. 1 in an open position.

A panel assembly 90 may be attached to or may contain the clamshell 20. As shown in FIG. 2, the panel assembly 90 may include an upper front section 92, a lower front section 94, right and left side sections 96, 98, top and bottom sections 100, 102, and a back section 104. Each of the "sections" of panel assembly 90 may also be referred to as "panels." The panel assembly 90 may cover at least a portion of one or both of the first and second parts 22, 54. As shown in FIGS. 1-2, the panel assembly 90 may be secured adjacent an outer surface of the clamshell 20 to generally receive the clamshell 20. The upper front section 92, lower front section 94, and right and left sections 96, 98 may define an access window 95 through which the product may be viewed and accessed. The access window 95 may generally align with the movable portion of the clamshell 20. In the illustrated embodiment shown in FIG. 2, the operating hinge 50 may be approximately aligned with an upper edge of the lower front section 94 of the panel assembly 90. This configuration may allow the movable portion of the clamshell 20 to pivot about the operating hinge 50 to move at least a portion of the first part 22 through the access window 95 when moving between the open and closed positions. Optionally, the operating hinge 50 may be positioned in any other suitable location with respect to the panel assembly 90, including being positioned within the access window 95. An aperture may be formed in the top section 100 of the panel assembly 90 to receive the hangtag 74. In the assembled package 10, various portions of the clamshell 20 may engage or contact various portions of the panel assembly 90. For example, upper front section 58 may contact upper front section 92, upper center section 25 may contact lower front section 94, right side section 24 may contact right side section 96, left side section 28 may contact left side section 98, flap 76 may contact top section 100 and/or bottom section 46 may contact bottom section 102. Further optionally, a rear edge of the clamshell 20 defined by bottom section 46, right and left side sections 68, 70, and top section 64 may contact back section 104 of panel assembly 90. Each of these interactions may be designed to provide a secure fit between clamshell 20 and panel assembly 90.

The package 10, clamshell 20 and panel assembly 90 may each have a depth generally oriented in a direction from the center section 26 of the first part 22 through the cavity 12 to the second part 54. In the illustrated embodiment, the depth may also be generally oriented in a direction from upper and lower front sections 92, 94, to the back section 104 of panel assembly 90. One or both of the side sections 96, 98 may at least partially define and extend along a depth of the package 10, clamshell 20 and/or panel assembly 90. One or both of the side sections 96, 98 may extend between the upper and lower front sections 92, 94, and the back section 104 of the panel assembly 90.

Figure 5:
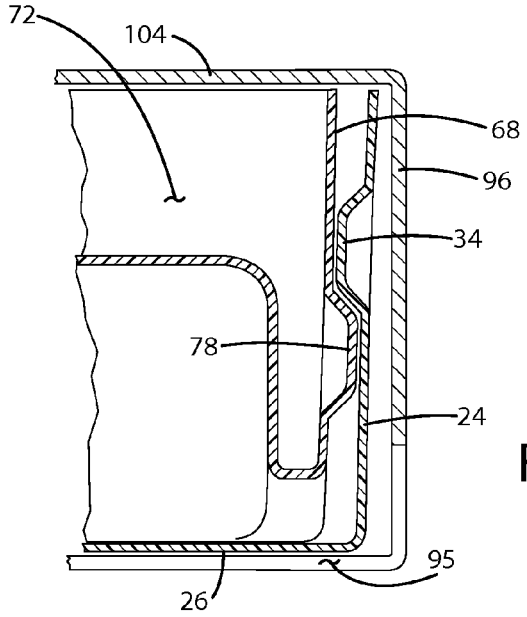
FIG. 5 is a sectional view along the line 5-5 in FIG. 1.
Figure 6:
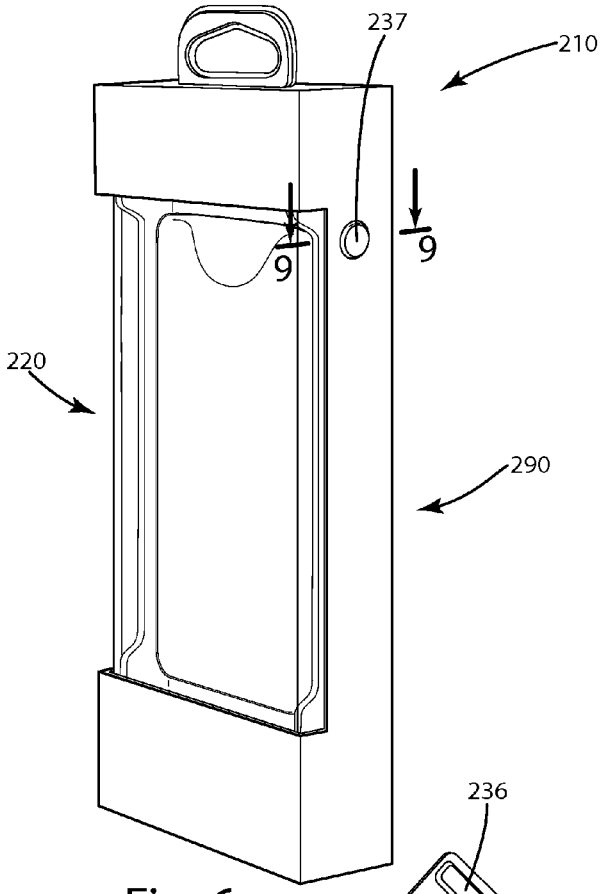
FIG. 6 is a perspective view of a package in accordance with a second embodiment of the present invention.
Figure 7:
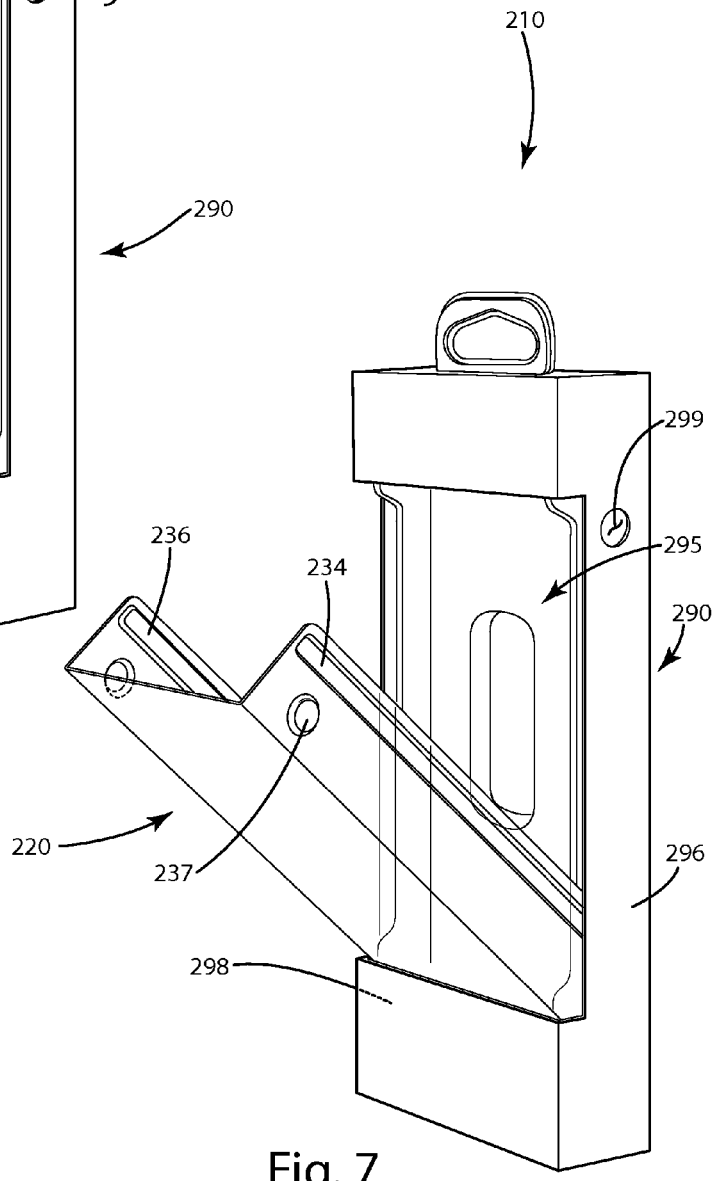
FIG. 7 is a perspective view of the package of FIG. 6 in an open position.
Figure 8:
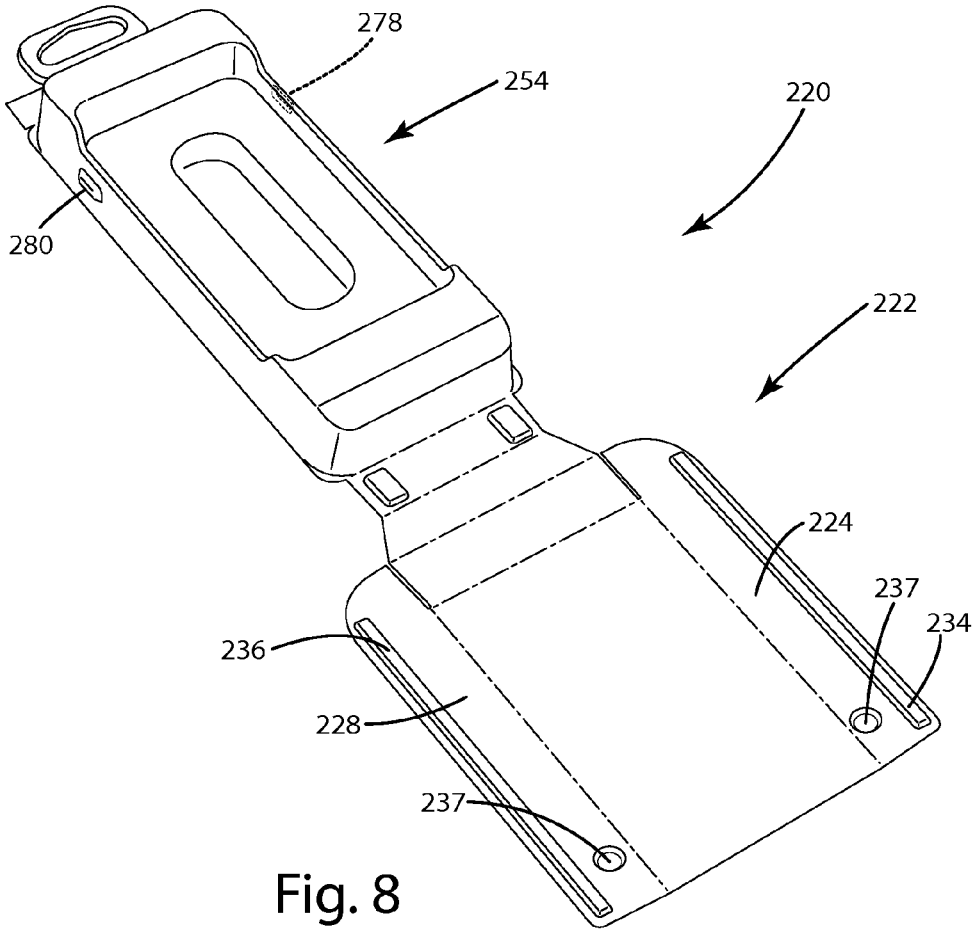
FIG. 8 is a perspective view of the clamshell in FIG. 6.
Figure 9:
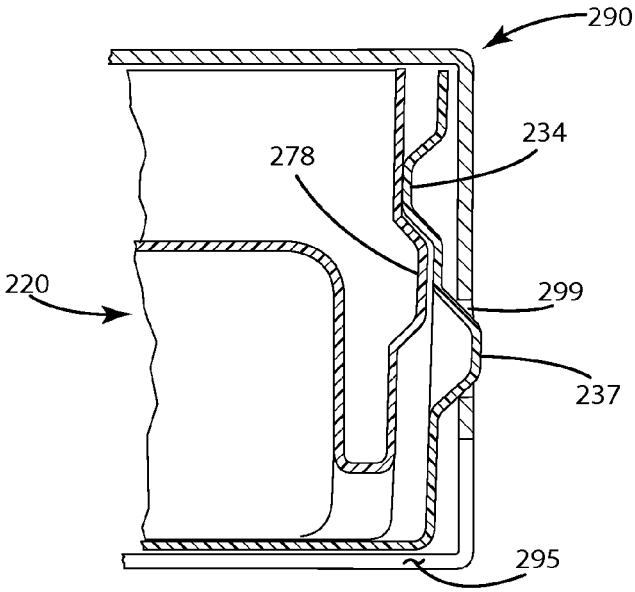
FIG. 9 is a sectional view along the line 9-9 in FIG. 6.
Figure 10:
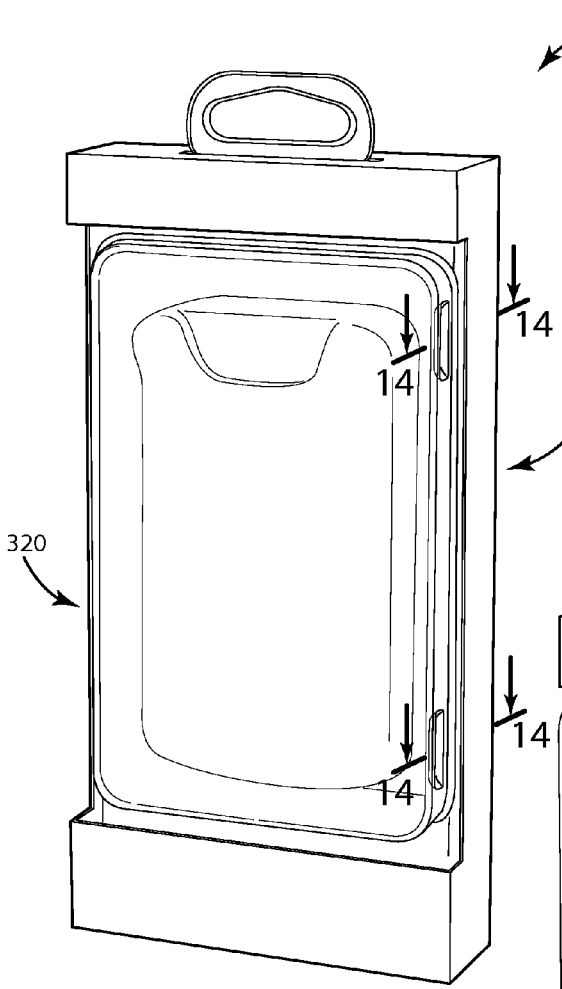
FIG. 10 is perspective view of a package in accordance with a third embodiment of the present invention.
Figure 11:
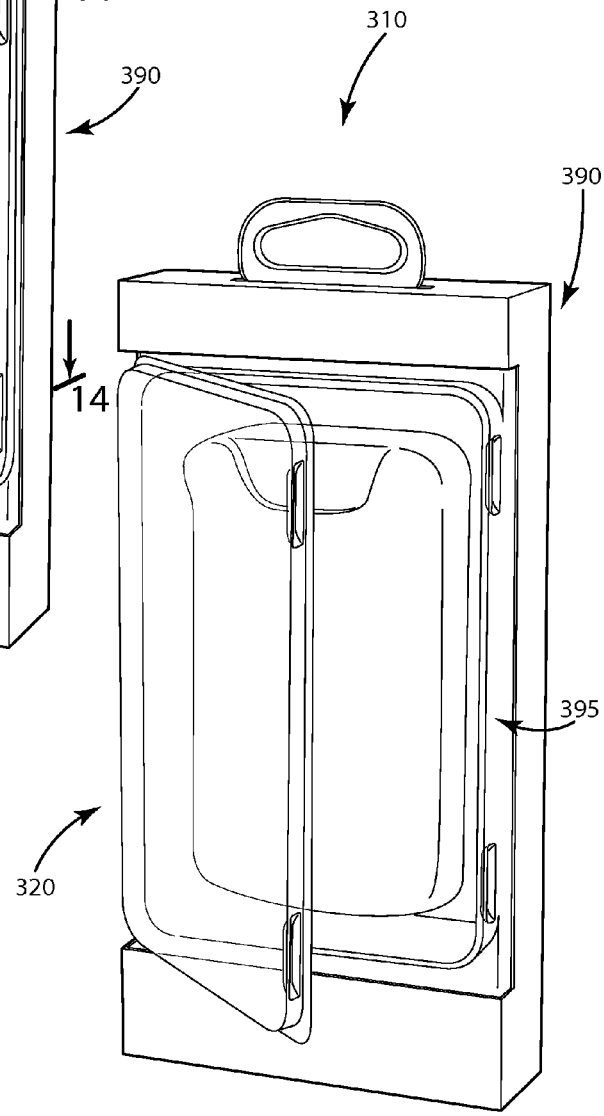
FIG. 11 is a perspective view of the package of FIG. 10 in an open position.
Figure 12:
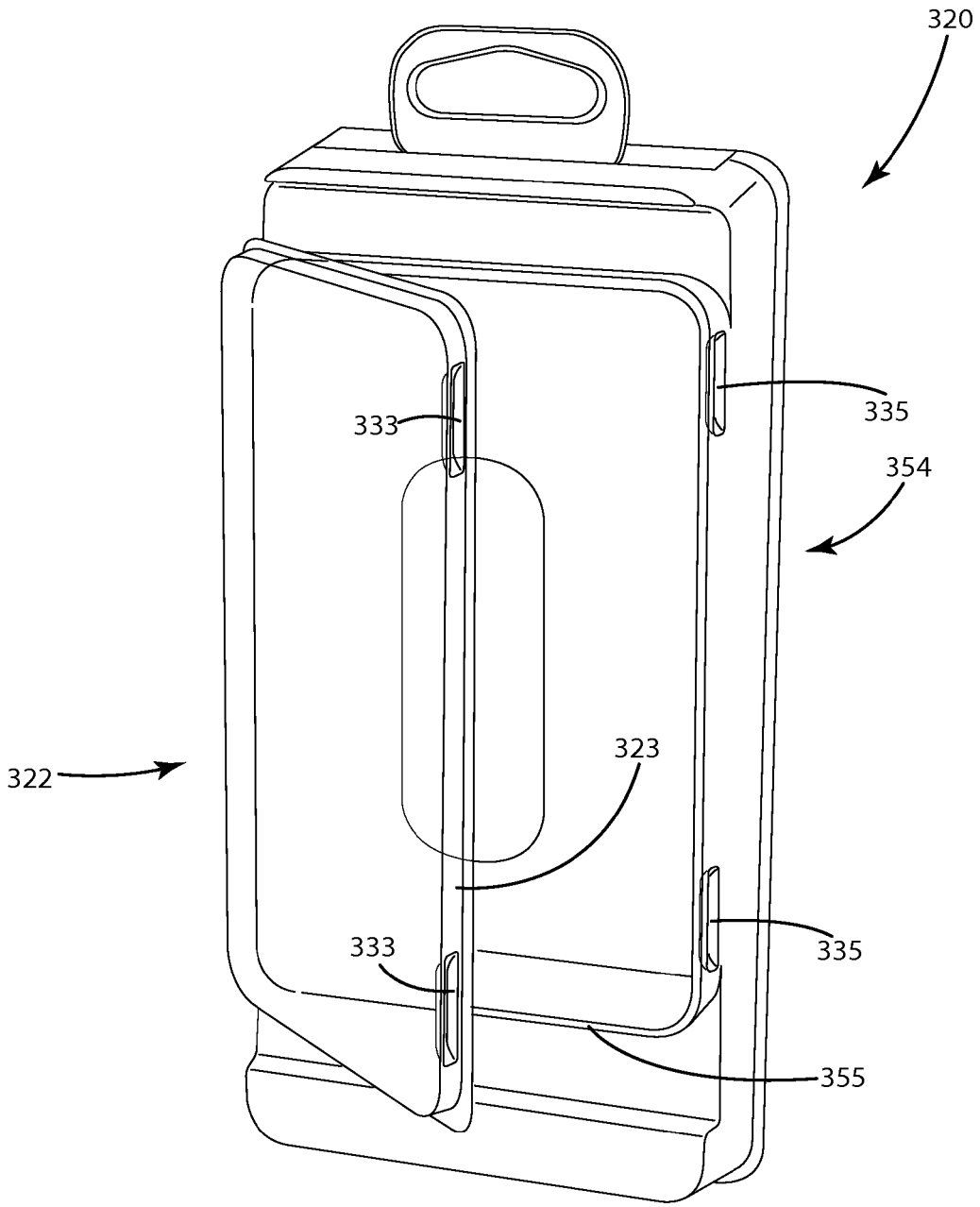
FIG. 12 is a perspective view of the clamshell of FIG. 10.
Figure 13:
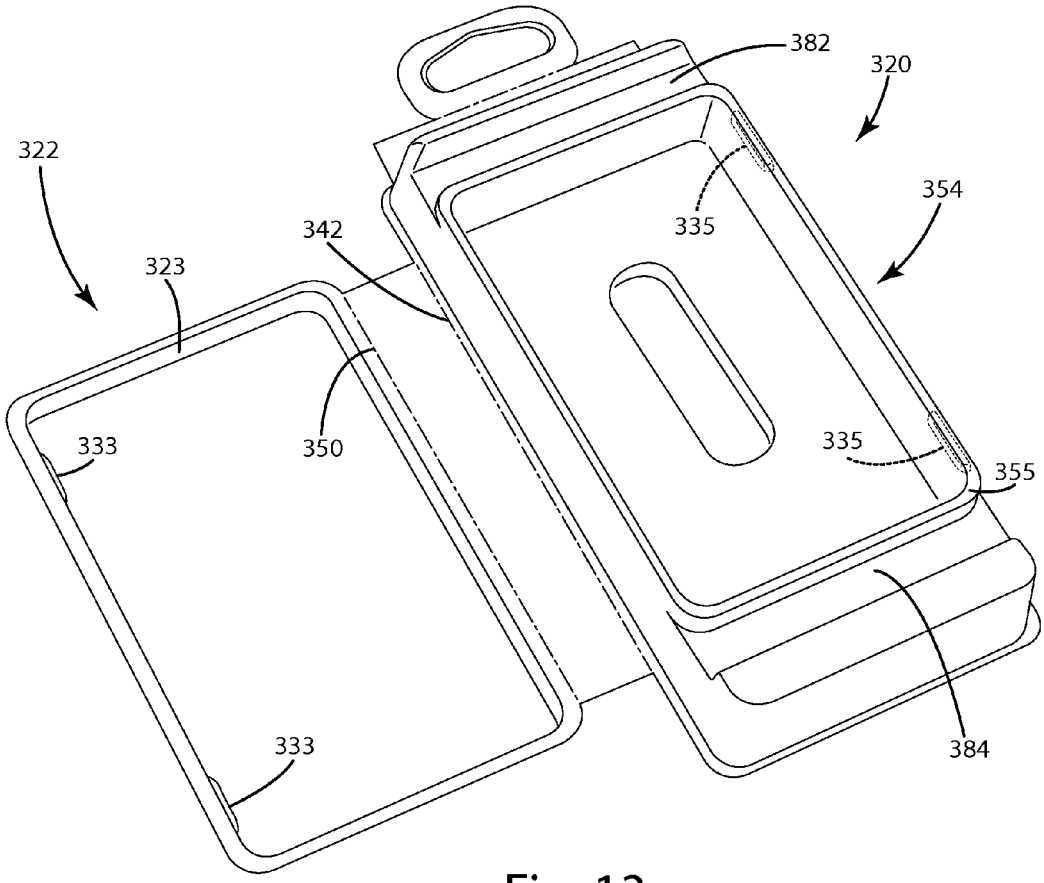
FIG. 13 is a perspective view of the clamshell of FIG. 10.
Figure 14:
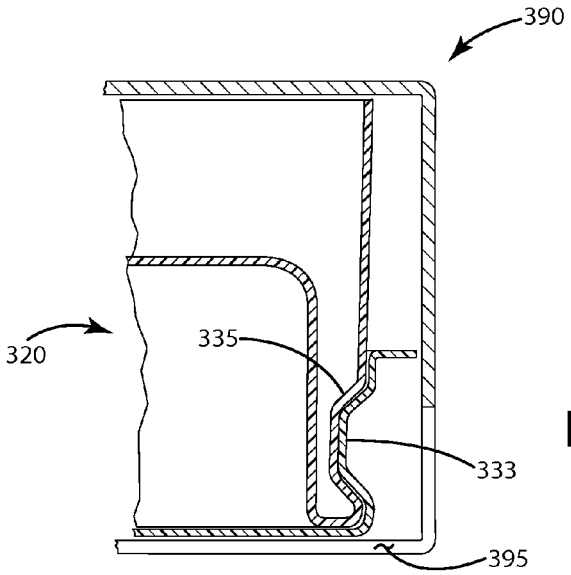
FIG. 14 is a sectional view along the lines 14-14 in FIG. 10.

The first part 22 may be releasably retained between the panel assembly 90 and the second part 54 when the first and second parts 22, 54 are in the closed position. In this configuration, the panel assembly 90 may assist in releasably retaining the package 10 in the closed position. The right and left sections 96, 98 of panel assembly 90 may be positioned adjacent the fastener elements 34, 36, 78, 80 and may discourage the movement of corresponding fastener elements past one another. For example, as shown in FIG. 5, the ramped surfaces of recesses 34, 36 and protrusions 78, 80 may force the right and left side sections 24, 28 of first part 22 outward, away from a center of the package 10 and into contact with the left and right side sections 96, 98 of panel assembly 90 when the package 10 is opened. The right and left side sections 96, 98 of panel assembly 90 may exert a reactive force inward, toward a center of the package 10 to discourage movement of the recesses 34, 36 past the protrusions 78, 80. Under a sufficient opening or closing force, at least one of the recesses 34, 36, the protrusions 78, 80 and the right and left side sections 96, 98 may deform to allow the recesses 34, 36 to pass by the protrusions 78, 80, thereby allowing the package 10 to be opened and closed.

The illustrated panel assembly 90 is a substantially rectangular box, but any suitable shapes and sizes are considered, depending on the shape and size of the product to be packaged, the shape and size of the clamshell 20, and aesthetic considerations. The shape and size of the access window 95 may also be altered depending on the size and shape of the product to be viewed and accessed, and the size and shape of the movable portion of the clamshell 20 to be moved through the access window 95. The portion of the clamshell 20 covered by the panel assembly 90 may be altered depending on desired aesthetic and functional characteristics of the package 10. For example, the panel assembly 90 may include one or more separate panels adhered to selected portions of the clamshell 20. The panel assembly 90 may be manufactured using essentially any manufacturing techniques, and can be constructed out of any suitable material, including paperboard, plastic and other materials commonly known in the art. For example, the panel assembly 90 may be die cut from a paperboard blank having a plurality of panels arranged to form the illustrated generally rectangular box. The paperboard blank may be provided with fold lines to facilitate folding of the blank into a box. Further, if desired, the blank may include tabs that allow the blank to be glued into the desired final shape. The panel assembly 90 may be configured to provide a box with a top and/or bottom that can be opened and closed, as desired. Alternatively, the panel assembly 90 may be configured to provide a box with a top and/or bottom that are glued or otherwise sealed.

In the illustrated embodiment, the clamshell 20 may open in a direction about the operating hinge 50 from the top down. However, it is contemplated that the clamshell 20 may open in any suitable direction, including from the bottom up and from either side.

A second embodiment of the box package is shown in FIGS. 6-9, and generally designated 210. Some of the elements of package 210 are arranged and function in a similar manner to corresponding elements in package 10. The similar elements will not be redescribed here, and like elements are denoted with the same reference number as in package 10, with a "2" placed in front.

Package 210 may have a different or additional fastener element as is used in the first embodiment. As shown in FIGS. 6-9, the package 210 may include one or more protrusions 237 extending from one or both of the right and left sections 224, 228 of the first part 222. The protrusion 237 may be visible and accessible through a fastener aperture 299 defined in one or both of the right and left sections 296, 298 of panel assembly 290. Optionally, the protrusion 237 may extend into or through the fastener aperture 299. The protrusion 237 and fastener aperture 299 may form an interference fit to releasably retain the package 210 in the closed position. In the embodiment illustrated in FIG. 9, the protrusion 237 and aperture 299 interfere with one another to discourage opening of the package 210. When the protrusion 237 is moved inward (by a customer, for example), and is clear of the fastener aperture 299, the package 210 may be moved to the open position. Optionally, if sufficient force is used to open the package 210, the protrusion 237 may automatically move inward and release from the aperture 299 without first being manually moved inward away from aperture 299. As illustrated, the package 210 may include recesses 234, 236, protrusions 278, 280, protrusion 237 and aperture 299 to releasably hold the first part 222 in the closed position. Further optionally, the package 210 may include only one fastening element, or any desired combination of fastening elements. Although the protrusion 237 is illustrated as a button and the fastener aperture 299 is illustrated as a cylindrical hole, any size and shape protrusion 237 and fastener aperture 299 may be used.

A third embodiment of the box package is shown in FIGS. 10-14 and generally designated 310. Some of the elements of package 310 are arranged and function in a similar manner to corresponding elements in package 10. The similar elements will not be redescribed here, and like elements are denoted with the same reference number as in package 10, with a "3" placed in front.

The clamshell 320 is divided into a first part 322 and a second part 354 by a manufacturing hinge 342. First part 322 may include an operating hinge 350 spaced from the manufacturing hinge 342 to allow a portion of the first part 322 to move during opening and closing of the package 310. The manufacturing hinge 342 and operating hinge 350 may be substantially parallel to each other. In the illustrated embodiment, the clamshell 320 may open in a "side" direction about the operating hinge 350. However, it is contemplated that the clamshell 320 may open in any suitable direction, including from the top down, from the bottom up, and from either side. Any suitable hinge may be used for the manufacturing hinge 342 and the operating hinge 350, including those discussed above.

The second part 354 may have a shoulder 355 for receiving a corresponding shoulder 323 on the first part 322. The shoulders 323, 355 may have corresponding fasteners to releasably retain the package 310 in the closed position. In the illustrated embodiment, the first part 322 has one or more recesses 333 adapted to snap fit with one or more recesses 335 in the second part 354. Although the illustrated embodiment includes two shoulders with corresponding fasteners, any suitable releasable fastening mechanism may be used, including those discussed above.

Two shelves 382, 384 may be formed in second part 354 to receive the panel assembly 390. The shelves 382, 384 may be lowered with respect to the shoulder 355 to positively locate the access window 395 relative to the shoulder 355 of the second part 354 and relative to the movable portion of the first part 322. Optionally, portions of the panel assembly 390 may extend inward, into the shelves 382, 384.

III. Manufacture and Use

A method is provided for forming a package 10 that may include (a) forming a clamshell 20 including a first part 22, a second part 54, an operating hinge 50, and a manufacturing hinge 42, (b) positioning the first part 22 adjacent the second part 54 to form a cavity 12 between the first part 22 and the second part 54, (c) securing a panel assembly 90 adjacent an outer surface of the first part 22 and the second part 54 to cover at least a portion of the first part 22 and the second part 54, and (d) pivoting the first part 22 away from the second part 54 about the operating hinge 50 to open the package 10. The method may further include defining at least part of a depth of the panel assembly 90 with at least one panel of the panel assembly 90 and may include moving at least a portion of the first part 22 through the access window 95 to open the package 10.

The clamshell 20 may be formed by placing a piece of sheet stock in a mold and thermoforming the clamshell 20. The molding or thermoforming step can include forming pockets in the respective first and/or second parts 22, 54. This step can also include forming the first part 22 with at least one recess 34, 36 and forming the second part 54 with at least one protrusion 78, 80. Lower front section 56 may be formed on the second part 54, including an angled section 57. An operating hinge 50, a second manufacturing hinge 44 and/or a third manufacturing hinge 45 may be formed in the first part 22, and the operating hinge 50 may be spaced from the manufacturing hinges 42, 44, 45. The clamshell 20 may be moved about the manufacturing hinges 42, 44, 45 during forming of the package 10. For example, the bottom section 46 of first part 22 may be pivoted about the manufacturing hinge 42 until the protrusions 47 contact the bottom section 66 of second part 54. Lower center section 27 may be pivoted about manufacturing hinge 44 until lower center section 27 forms approximately a 45° angle with the bottom section 66 and/or lower center section 27 contacts angled section 57. Upper center section 25 may be pivoted about manufacturing hinge 45 until the upper center section 25 forms approximately a 45° angle with lower center section 27 and approximately a 90° angle with bottom section 66. Optionally, any of these angular configurations may be varied.

The molding or thermoforming step may include forming a radius and/or an angle 38, 40 in the first part 22 of the clamshell 20 to provide clearance for the first part 22 while opening and closing the package 10, and may further include separating a portion of the first part 22 to facilitate movement of the first part 22 during opening of the package 10. For example, a portion of the left and right sections 24, 28 of the first part 22 may be separated from a portion of the center section 26 of the first part 22. During pivoting of the first part 22 away from the second part 54, the separated portion of the left and right sections 24, 28 may be moved within a void 31 formed by the clamshell 20 and panel assembly 90. The radius and/or angle 38, 40 may contact the panel assembly 90 when the package 10 is opened and closed.

The panel assembly 90 may be formed by any conventional method. An access window 95 may be defined in the panel assembly 90 by the upper and lower front sections 92, 94 and the right and left side sections 96, 98. The panel assembly 90 may be secured to the clamshell 20. For example, the panel assembly 90 may receive the clamshell 20. Optionally, the panel assembly 90 may be formed around the clamshell 20. In this option, the panel assembly 90 may be formed and may be folded around the clamshell 20 to capture the clamshell 20. Further optionally, the panel assembly 90 may include one or more separate panels, which may be separately attached to the clamshell 20. Once the panel assembly 90 is secured, a consumer may open at least a portion of the first part 22 through the access window 95 to access and remove the product. After the consumer is finished, the product may be returned to the package 10 and at least a portion of the first part 22 may be closed through the access window 95 to close the package 10.

During opening and closing of the package 10, releasable fasteners 34, 36, 78, 80 may be engaged and disengaged from one another. For example, during closing of the package 10, the right side section 24 of first part 22 may be inserted between right side section 96 of panel assembly 90 and right side section 68 of second part 54, as shown in FIG. 5. During this insertion, the ramped surfaces of recess 34 and protrusion 78 may contact one another to resist further insertion of right side section 24. As more force is used to close the package, one or more of right side section 24 of first part 22, right side section 68 of second part 54 and right side section 96 of panel assembly 90 may deform or otherwise move to allow the recess 34 to move past the protrusion 78 and into the closed, releasably locked position. The process is generally reversed to move the package 10 to the open position.

In another embodiment, the method of forming the package 10 may include forming a fastener aperture 299 in the panel assembly 290, exposing at least a portion of the first part 222 of the clamshell 220 through the fastener aperture 299, and pressing the at least a portion of the first part 222 of the clamshell 220 to open the package 210. For example, a protrusion 237 may be exposed through the fastener aperture 299. A consumer may press the protrusion 237 inward, moving the protrusion out of contact with the fastener aperture 299 and releasing the first part 222. Optionally, if sufficient force is used to pull open first part 222, the protrusion 237 may automatically move out of engagement with fastener aperture 299 under the increased force, and the first part 222 may be released.

In another embodiment, closing the package 310 may include engaging corresponding shoulders 323, 355 in the first and second parts 322, 354. The shoulders 323, 355 may include snap fit fasteners 333, 335 that may be engaged to releasably retain the package 310 in the closed position. One or more shelves 382, 384 may be formed in the second part 354 so that the panel assembly 390 may be positively located relative to the clamshell 320. Portions of the panel assembly 390 may be received by the shelves 382, 384 during forming of the package 310.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are as follows:

1. A box package for packaging an article comprising:

a box defining an interior space and having an access window; and a clamshell fitted within said box, the clamshell being of a one-piece construction and including a first part and a second part adapted to form a cavity, the first part joined to the second part along a manufacturing hinge, the manufacturing hinge arranged to allow the first part to fold into a position adjacent the second part, the first part including an operating hinge configured to allow the first part to move between an open position and a closed position, the operating hinge disposed adjacent the access window, whereby the first part is movable between the open position and the closed position through the access window.

2. The package of claim 1 wherein the box includes a panel assembly, the panel assembly defining the access window, at least a portion of the first part adapted to open through the access window.

3. The package of claim 1 wherein the panel assembly has a depth in a direction from a face of the first part through the cavity to the second part.

4. The package of claim 1 wherein at least one of the first and second parts have at least one fastener element, the at least one fastener element adapted to releasably secure the first and second parts in the closed position.

5. The package of claim 4 wherein the at least one fastener element includes a recess defined in the first part and a protrusion defined in the second part.

6. The package of claim 4 wherein at least a portion of the first part is releasably retained between at least a portion of the panel assembly and at least a portion of the second part when the first and second parts are in the closed position.

7. The package of claim 4 wherein at least a portion of the at least one fastener element protrudes through a fastener aperture defined in the panel assembly.

8. The package of claim 4 wherein the first part includes at least one of a radius and an angle configured to provide clearance for the first part when the first and second parts are moved between the open and closed positions.

9. A package for packaging an article comprising:

a clamshell including a first part and a second part adapted to form a cavity, the first and second parts movable relative to one another about an operating hinge between an open position and a closed position, the clamshell including at least one manufacturing hinge dividing the first and second parts; and a panel assembly covering at least a portion of each of the first and second parts, the panel assembly defining an access window, at least a portion of the first part movable through the access window.

10. The package of claim 9 wherein the panel assembly has at least one panel at least partially extending along a depth of the panel assembly defined between a front panel of the panel assembly and a rear panel of the panel assembly.

11. The package of claim 10 wherein the first and second parts have at least one fastener element, the at least one fastener element adapted to releasably secure the first and second parts in the closed position.

12. The package of claim 11 wherein the first part includes first and second sections substantially parallel to one another, the first and second sections each having at least one fastener element, the first and second sections separated by a third section substantially perpendicular to the first and second sections.

13. The package of claim 9 wherein the first part includes at least one of a radius and an angle configured to provide clearance for the first part when the first and second parts are moved between the open and closed positions.

14. The package of claim 13 wherein the clamshell includes at least two manufacturing hinges.

15. The package of claim 11 wherein the first and second parts each have a shoulder that includes the at least one fastening element.

16. The package of claim 15 wherein the shoulder in the second part receives at least a portion of the first part.

* * * * *